US009975562B2

(12) United States Patent
Sakahira et al.

(10) Patent No.: US 9,975,562 B2
(45) Date of Patent: May 22, 2018

(54) RAILCAR

(71) Applicant: KAWASAKI JUKOGYO KABUSHIKI KAISHA, Kobe-shi, Hyogo (JP)

(72) Inventors: Masahiro Sakahira, Akashi (JP); Mitsuru Yokoyama, Kobe (JP); Kazuo Isomura, Kobe (JP); Takanori Tojo, Akashi (JP); Satoshi Ikeda, Kobe (JP); Tomohide Maeba, Akashi (JP); Naoki Hikosaka, Kobe (JP); Tomohiro Narita, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 142 days.

(21) Appl. No.: 14/954,649

(22) Filed: Nov. 30, 2015

(65) Prior Publication Data

US 2017/0151963 A1 Jun. 1, 2017

(51) Int. Cl.

| | |
|---|---|
| ***B61F 1/14*** | (2006.01) |
| ***B61F 3/02*** | (2006.01) |
| ***B61F 5/22*** | (2006.01) |
| ***B61F 5/10*** | (2006.01) |

(52) U.S. Cl.

CPC ..... *B61F 1/14* (2013.01); *B61F 3/02* (2013.01); *B61F 5/10* (2013.01); *B61F 5/22* (2013.01)

(58) Field of Classification Search

CPC ..... B61F 5/22; B61F 5/10; B61F 1/14; B60G 17/052

USPC ..... 105/453

See application file for complete search history.

(56) References Cited

U.S. PATENT DOCUMENTS 3,719,152 A * 3/1973 Harter ..... B61F 5/24 105/164
3,789,771 A * 2/1974 Jackson ..... B61F 5/144 105/164
3,894,707 A * 7/1975 Heard ..... F16B 2/08 248/225.11
4,231,554 A * 11/1980 Ekonen ..... B60G 17/0525 137/625.68

(Continued)

FOREIGN PATENT DOCUMENTS

DE 4343998 A1 * 7/1995 ..... B61F 5/22
JP S6040836 A 3/1985
JP H1178876 A 3/1999

*Primary Examiner* — Robert J McCarry, Jr.
*Assistant Examiner* — Scott A Browne
(74) *Attorney, Agent, or Firm* — Oliff PLC

(57) ABSTRACT

A railcar includes: a carbody; a bogie constituting member including an interface plate provided at a lower portion of the carbody, an air spring, and a bogie; an automatic level controlling valve configured to maintain a height of the spring within a certain range; a first attaching portion provided on a side surface of the plate, the valve being detachably attached to the side surface of the plate by the first attaching portion; and attaching means provided at the lower portion of the carbody, the valve being detachably attached to the lower portion of the carbody by the attaching means, the bogie constituting member being separable from the carbody in a state where the valve is attached to the side surface of the plate through the first attaching portion or a state where the valve is attached to the lower portion of the carbody through the attaching means.

5 Claims, 7 Drawing Sheets

(56) References Cited

U.S. PATENT DOCUMENTS

| | | | | | |
|---|---|---|---|---|---|
| 4,676,173 | A * | 6/1987 | Mielcarek | B61F 5/144 | 105/182.1 |
| 4,693,185 | A * | 9/1987 | Easton | B60G 17/052 | 105/198.1 |
| 5,161,579 | A * | 11/1992 | Anderson, Jr. | B60G 17/0525 | 137/627.5 |
| 6,783,138 | B2 * | 8/2004 | Reiner | B60G 17/0523 | 280/124.16 |
| 7,204,478 | B2 * | 4/2007 | Plath | F15B 13/0406 | 267/64.17 |
| 7,887,065 | B2 * | 2/2011 | Trudeau | B60G 17/0155 | 280/5.514 |
| 8,191,904 | B2 * | 6/2012 | Amlie | B60G 17/018 | 267/64.16 |
| 8,651,026 | B2 * | 2/2014 | Maeyama | B61F 5/10 | 105/199.2 |
| 8,973,922 | B2 * | 3/2015 | Koelzer | F16K 11/0525 | 137/625.6 |
| 9,643,622 | B2 * | 5/2017 | Maeyama | B61B 13/00 | |
| 2012/0160126 | A1 * | 6/2012 | Rathbun | B61B 10/022 | 105/238.1 |

* cited by examiner

RAILCAR

BACKGROUND OF THE INVENTION

Field of the Invention

The present invention relates to a railcar including an automatic level controlling valve of an air spring provided between a carbody and a bogie.

Description of Related Art

A railcar includes an air spring as a secondary suspension between a carbody and a bogie. The air spring is provided with an automatic level controlling valve. The automatic level controlling valve supplies air, supplied from an air supplying portion included in the carbody, to an inside of the air spring or discharges the air from the inside of the air spring. A height of the carbody is adjusted by the automatic level controlling valve in accordance with a change in weight or behavior of the carbody. There exists a railcar in which such an automatic level controlling valve is attached to the carbody (see Japanese Unexamined Patent Application Publication No. S60-40836, for example). Further, there also exists a railcar in which: the air spring is fixed to the bogie; and the carbody is mounted on an interface plate provided at an upper portion of the air spring. In this railcar, the automatic level controlling valve is attached to the interface plate from below.

SUMMARY OF THE INVENTION

For example, when performing the maintenance of the railcar, a bogie constituting member including the bogie, the air spring, and the interface plate is separated from the carbody. The maintenance of the bogie constituting member and the maintenance of the carbody are performed separately. As described above, the automatic level controlling valve is attached to the interface plate from below. Therefore, the maintenance of the automatic level controlling valve can be performed together with the maintenance of the bogie constituting member with the automatic level controlling valve attached to the interface plate. On the other hand, the automatic level controlling valve is connected to the air supplying portion of the carbody through an air supply pipe. Therefore, there is also a demand for performing the maintenance of the automatic level controlling valve together with the maintenance of the carbody with the automatic level controlling valve connected to the air supply pipe of the carbody.

However, according to a conventional configuration, even if the automatic level controlling valve is detached from the interface plate, the interface plate exists above the automatic level controlling valve. Therefore, it is difficult to separate the carbody from the bogie constituting member with the automatic level controlling valve connected to the air supply pipe of the carbody.

The present invention is a railcar including: a carbody; a bogie constituting member including an interface plate provided at a lower portion of the carbody, an air spring provided at a lower portion of the interface plate, and a bogie provided at a lower portion of the air spring; an automatic level controlling valve configured to supply air to the air spring and discharge the air from the air spring to maintain a height of the air spring within a certain range; a first attaching portion provided on a side surface of the interface plate, the automatic level controlling valve being detachably attached to the side surface of the interface plate by the first attaching portion; and attaching means provided at the lower portion of the carbody, the automatic level controlling valve being detachably attached to the lower portion of the carbody by the attaching means, the bogie constituting member being separable from the carbody in a state where the automatic level controlling valve is attached to the side surface of the interface plate through the first attaching portion or a state where the automatic level controlling valve is attached to the lower portion of the carbody through the attaching means.

According to the above configuration, when separating the bogie constituting member from the carbody, and if a state where the automatic level controlling valve is attached to the bogie constituting member needs to be maintained, the bogie constituting member is separated from the carbody with the automatic level controlling valve attached to the side surface of the interface plate through the first attaching portion. Therefore, when separating the bogie constituting member from the carbody, a state where the automatic level controlling valve is attached to the bogie constituting member can be realized.

When separating the bogie constituting member from the carbody, and if a state where the automatic level controlling valve is attached to the lower portion of the carbody needs to be maintained, the bogie constituting member is separated from the carbody with the automatic level controlling valve attached to the lower portion of the carbody through the attaching means. Therefore, when separating the bogie constituting member from the carbody, the state where the automatic level controlling valve is attached to the carbody can be realized.

As above, to separate the bogie constituting member from the carbody and perform the maintenance of the bogie constituting member and the maintenance of the carbody separately, the state where the automatic level controlling valve is attached to the bogie constituting member or the state where the automatic level controlling valve is attached to the lower portion of the carbody can be selected when separating the bogie constituting member from the carbody.

Further, when separating the bogie constituting member from the carbody, and if a state where the automatic level controlling valve fixed to the interface plate is attached to the carbody needs to be realized, the automatic level controlling valve is detached from the side surface of the interface plate, so that the automatic level controlling valve can be moved upward. Therefore, a state where the automatic level controlling valve is attached to the lower portion of the carbody through the attaching means can be realized without the interference of the automatic level controlling valve with the interface plate.

The above and further objects and features of the invention will more fully be apparent from the following detailed description with reference to accompanying drawings.

DETAILED DESCRIPTION OF THE PREFERRED EMBODIMENTS

Figure 1:
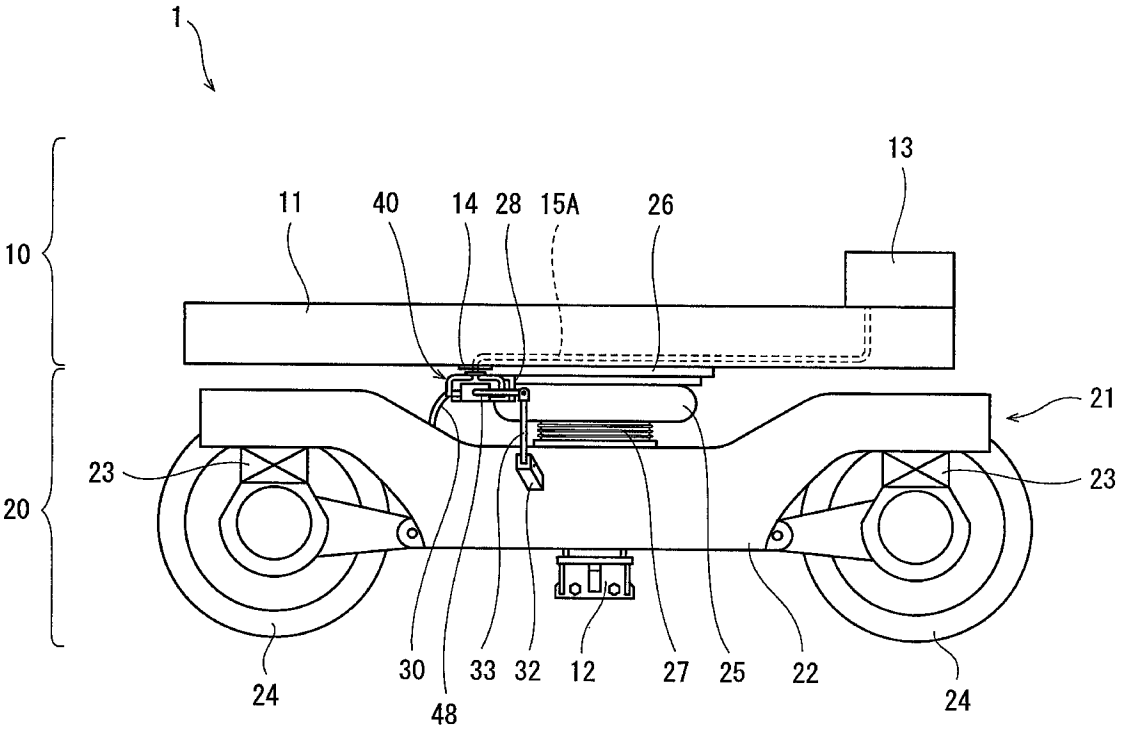
FIG. 1 is a side view showing a part of a bogie and carbody of a railcar according to one embodiment.

Hereinafter, embodiments will be explained in reference to the drawings. In the following explanations, each of a direction in which a railcar travels and a length direction in which a carbody extends is defined as a forward/rearward direction, and a lateral direction perpendicular to the forward/rearward direction is defined as a leftward/rightward direction. In the drawings, the same reference signs are used for the same components.

FIG. 1 is a side view showing a part of a bogie 21 and carbody 10 of a railcar 1 according to one embodiment. As respective parts of a bogie constituting member 20, FIG. 1 shows: the bogie 21; a side sill 22 of the bogie 21; wheels 24 provided through axle springs 23 provided at the side sill 22; an air spring 25 provided at an upper portion of the side sill 22; and an interface plate 26 provided at an upper portion of the air spring 25. A pair of side sills 22, pairs of axle springs 23, pairs of wheels 24, and a pair of air springs 25 are provided in the leftward/rightward direction of the bogie 21. As respective parts of the carbody 10, FIG. 1 shows: a carbody frame 11 located at the bogie; a center pin 12 at which a traction device is provided, the traction device being configured to pull the carbody 10 by the bogie 21; and an air supplying portion 13 configured to supply air to the air spring 25. The center pin 12 is fixed to the carbody frame 11. The air spring 25 is connected to the carbody frame 11 through the interface plate 26 provided at a lower portion of the carbody 10. An elastic supporting member 27 provided at a lower portion of the air spring 25 is fixed to the side sill 22.

A first attaching portion 28 is provided on a side surface of the interface plate 26. An automatic level controlling valve 40 is detachably attached to the first attaching portion 28. The automatic level controlling valve 40 supplies the air to an inside of the air spring 25 or discharges the air from the inside of the air spring 25.

The automatic level controlling valve 40 adjusts internal pressure of the air spring 25 in accordance with a vertical motion of the carbody 10. A height of the air spring 25 is maintained within a certain range by the automatic level controlling valve 40. The automatic level controlling valve 40 is provided with a lever 48 extending toward a lateral side. The side sill 22 of the bogie constituting member 20 is provided with a bracket 32 projecting toward the lateral side. A tip end portion of the lever 48 of the automatic level controlling valve 40 and the bracket 32 of the side sill 22 are coupled to each other through a link 33. When the bracket 32 moves upward, the tip end portion of the lever 48 swings upward through the link 33. Further, when the bracket 32 moves downward, the tip end portion of the lever 48 swings downward through the link 33. The automatic level controlling valve 40 detects an increase or decrease in the height of the air spring 25 based on a swing angle of the tip end portion of the lever 48. The automatic level controlling valve 40 mechanically opens or closes by the swinging of the tip end portion of the lever 48 to supply the air to the inside of the air spring 25 or discharge the air from the inside of the air spring 25. Thus, the automatic level controlling valve 40 maintains the height of the railcar constant. A first pipe 15A connected to the air supplying portion 13 of the carbody 10 and a second pipe 30 connected to an air chamber (such as an inside of the side sill 22) of the air spring 25 are connected to the automatic level controlling valve 40. The first pipe 15A is an air supply pipe, the air being supplied from the air supplying portion 13 of the carbody 10 through the air supply pipe to the automatic level controlling valve 40. The second pipe 30 is a pipe, the air being supplied or discharged between the air chamber of the air spring 25 and the automatic level controlling valve 40 through the pipe. The automatic level controlling valve 40 includes an air outlet (not shown), the air being discharged from the air chamber of the air spring 25 through the air outlet.

When the tip end portion of the lever 48 coupled to the bracket 32 of the side sill 22 through the link 33 moves downward, the automatic level controlling valve 40 detects the decrease in the height of the air spring 25. When the automatic level controlling valve 40 detects the decrease in the height of the air spring 25, the automatic level controlling valve 40 supplies the air from the air supplying portion 13 of the carbody 10 to the air spring 25 so as to increase the internal pressure of the air spring 25. In contrast, when the tip end portion of the lever 48 coupled to the bracket 32 of the side sill 22 through the link 33 moves upward, the automatic level controlling valve 40 detects the increase in the height of the air spring 25. When the automatic level controlling valve 40 detects the increase in the height of the air spring 25, the automatic level controlling valve 40 discharges the air from the inside of the air spring 25 so as to decrease the internal pressure of the air spring 25.

Further, attaching means for detachably attaching the automatic level controlling valve 40 to the lower portion of the carbody 10 is provided at the lower portion of the carbody 10 and above the automatic level controlling valve 40. In the present embodiment, the attaching means is a second attaching portion 14, the automatic level controlling valve 40 being attached to the lower portion of the carbody 10 by the second attaching portion 14 using a below-described jig 50 or 60, a belt, or the like. The second attaching portion 14 shown in the drawings is a rectangular member including an opening portion 17. The second attaching portion 14 shown in the drawings is fixed to a lower surface of the carbody 10. When performing the maintenance of the railcar 1 in which the carbody 10 and the bogie constituting member 20 are separated from each other, the automatic level controlling valve 40 is attached to the second attaching portion (attaching means) 14. Therefore, the railcar 1 is not in a traveling state but in a state of being quietly moved by a crane or the like in a maintenance factory or being stored in the maintenance factory. Therefore, for ease of handleability, a state where the automatic level controlling valve 40 is attached to the second attaching portion 14 may be a state where the automatic level controlling valve 40 is mounted on and supported by the below-described jig 50 or 60. Further, for example, the attaching means may be a bolt which is provided at the lower portion of the carbody 10 and by which the automatic level controlling valve 40 is attached to the lower portion of the carbody 10. Further, for example, the attaching means may be a hook-and-loop fastener by which the automatic level controlling valve 40 is attached to the lower portion of the carbody 10. Further, for example, the attaching means may be a hook portion which is provided at the lower portion of the carbody 10 and by which the automatic level controlling valve 40 is hooked to the lower portion of the carbody 10. Further, for example, the attaching means may be a belt which is provided at the lower portion of the carbody 10 and by which the automatic level controlling valve 40 is suspended from the lower portion of the carbody 10. Further, for example, the attaching means may be a rod by which the automatic level controlling valve 40 is suspended from the lower portion of the carbody 10.

Figure 2:
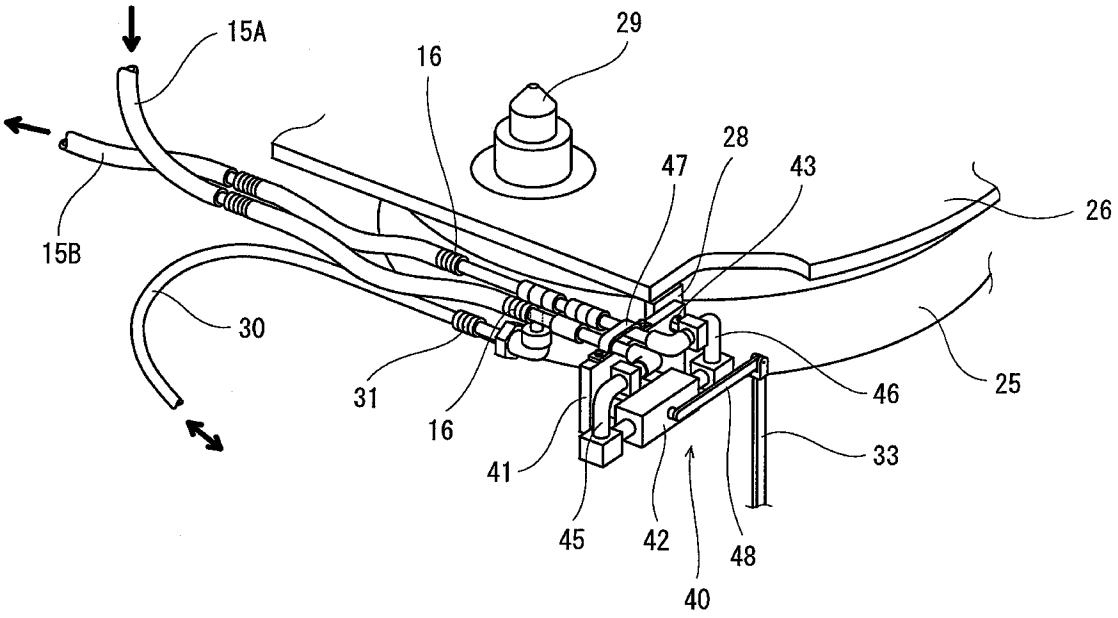
FIG. 2 is a perspective view showing an automatic level controlling valve attached to an interface plate of an air spring of the bogie of the railcar shown in FIG. 1.
Figure 3:
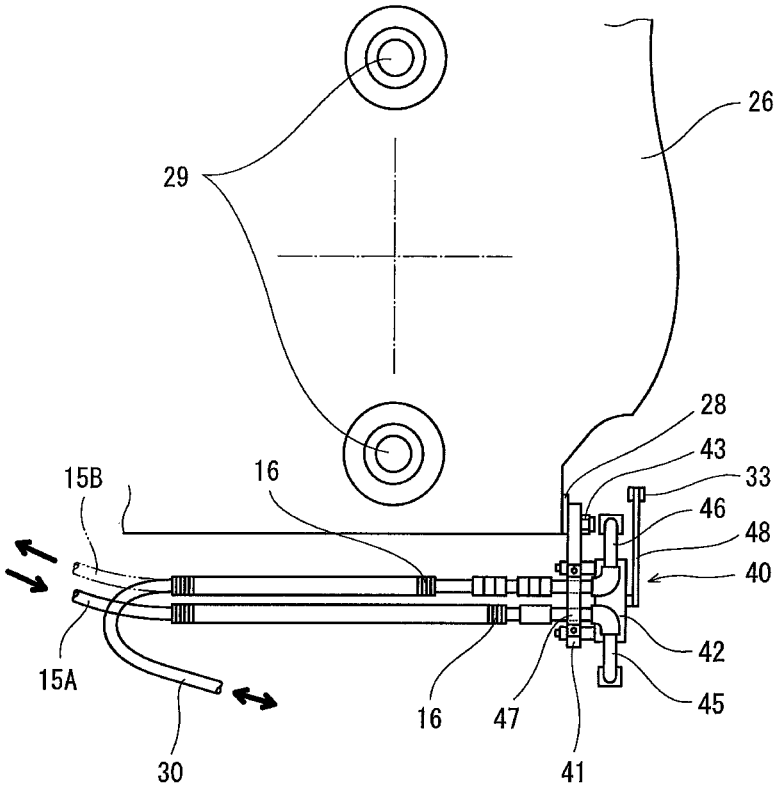
FIG. 3 is a plan view showing the automatic level controlling valve shown in FIG. 2 and a part of the air spring.

FIG. 2 is a perspective view showing the automatic level controlling valve 40 attached to the interface plate 26 of the air spring 25 included in the bogie 21. FIG. 3 is a plan view showing the automatic level controlling valve 40 and a part of the air spring 25. In FIGS. 2 and 3, the carbody 10 is omitted. As shown in FIGS. 2 and 3, a locking pin 29 is provided on an upper surface of the interface plate 26. The interface plate 26 is locked at a predetermined position of the carbody 10 by the locking pin 29. The first attaching portion 28 is provided on the side surface of the interface plate 26. The first attaching portion 28 is formed by a plate member extending in an upward/downward direction.

The automatic level controlling valve 40 of the present embodiment includes a fixing plate 41 and a valve main body 42. The fixing plate 41 is a portion by which the automatic level controlling valve 40 is detachably fixed to the first attaching portion 28 from a lateral direction (horizontal direction) by using a bolt-nut 43. The valve main body 42 is fixed to the fixing plate 41. The valve main body 42 is provided with a first connection pipe 45, the first pipe 15A (air supply pipe) connected to the air supplying portion 13 (see FIG. 1) of the carbody 10 being connected to the first connection pipe 45. Further, the valve main body 42 is provided with a second connection pipe 46 to which the second pipe 30 connected to an air chamber (not shown) of the bogie 21 is connected. The first connection pipe 45 and the second connection pipe 46 are fixed to an upper surface of the fixing plate 41 by a fixing band 47. A first pipe 15B is connected to the second connection pipe 46. The first pipe 15B is connected to a pressure gauge (not shown) mounted on the carbody. The first pipe 15B is provided so as to branch from the second pipe 30. It should be noted that the first pipe 15A and the first pipe 15B may be collectively called a "first pipe 15".

When separating the bogie constituting member 20 from the carbody 10, and if a state where the automatic level controlling valve 40 is attached to the first attaching portion 28 provided on the side surface of the interface plate 26 needs to be maintained, the state where the automatic level controlling valve 40 is attached to the first attaching portion 28 is maintained. With this, when separating the bogie constituting member 20 from the carbody 10, the state where the automatic level controlling valve 40 is attached to the bogie constituting member 20 can be realized.

On the other hand, when separating the bogie constituting member 20 from the carbody 10, and if a state where the automatic level controlling valve 40 is attached to the lower portion of the carbody 10 needs to be maintained, first, the lever 48 or link 33 coupling the automatic level controlling valve 40 to the bracket 32 projecting from the side sill 22 of the bogie constituting member 20 is detached at one position. In addition, the second pipe 30 communicating with the air chamber of the air spring 25 of the bogie 21 is detached at a connector portion 31. Next, the bolt-nut 43 by which the fixing plate 41 of the automatic level controlling valve 40 is fixed to the first attaching portion 28 is detached. Then, a state where the automatic level controlling valve 40 is attached to the second attaching portion 14 of the lower portion of the carbody 10 is realized (see FIG. 5). With this, the state where the automatic level controlling valve 40 is attached to the carbody 10 can be realized when separating the bogie constituting member 20 from the carbody 10.

Figure 4:
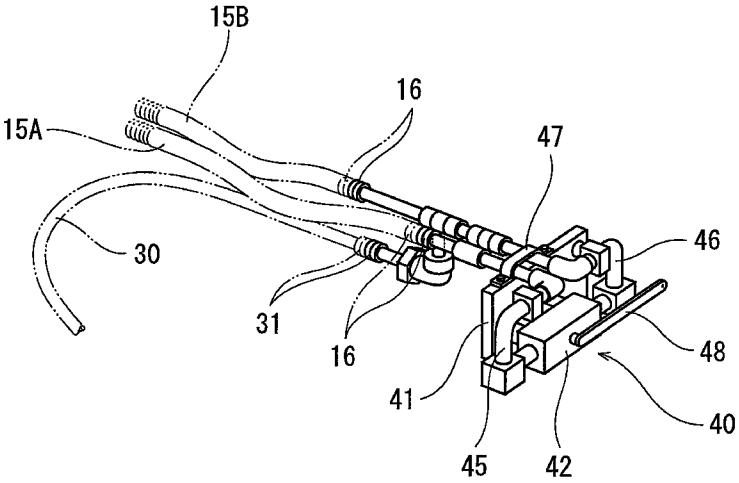
FIG. 4 is a perspective view showing a state where the automatic level controlling valve shown in FIG. 2 is detached from the interface plate.

As shown in FIG. 4, connector portions 16 of the first pipe 15 connected to the automatic level controlling valve 40 and the connector portion 31 of the second pipe 30 are provided near the automatic level controlling valve 40. Therefore, when separating the carbody 10 and the bogie constituting member 20 from each other, work of detaching the connector portions 16 of the first pipe 15 connected to the automatic level controlling valve 40 and the connector portion 31 of the second pipe 30 can be performed near the automatic level controlling valve 40. To realize the state where the automatic level controlling valve 40 is attached to the bogie constituting member 20, the connector portions 16 of the first pipe 15 are detached. To realize the state where the automatic level controlling valve 40 is attached to the carbody 10, the connector portion 31 of the second pipe 30 is detached. Since the connector portions 16 and 31 can be detached near the automatic level controlling valve 40, labor required to detach the pipes 15 and 30 when separating the bogie constituting member 20 from the carbody 10 can be reduced. In FIG. 4, a state where the automatic level controlling valve 40 is detached from the first attaching portion 28 of the interface plate 26 is shown by solid lines. A state where the connector portions 16 and 31 are detached from the automatic level controlling valve 40 is shown by solid lines.

When positions of the connector portions 16 and the connector portion 31 are located near the automatic level controlling valve 40, the connector portions 16 and the connector portion 31 can be easily detached at the time of detachment of the automatic level controlling valve 40. The positions of the connector portions 16 and 31 are not limited to the positions in the present embodiment. Each of the connector portions 16 and 31 is configured as a one-touch type in the present embodiment. However, each of the connector portions 16 and 31 may be configured as a screw type and is not limited to the present embodiment.

Figure 5:
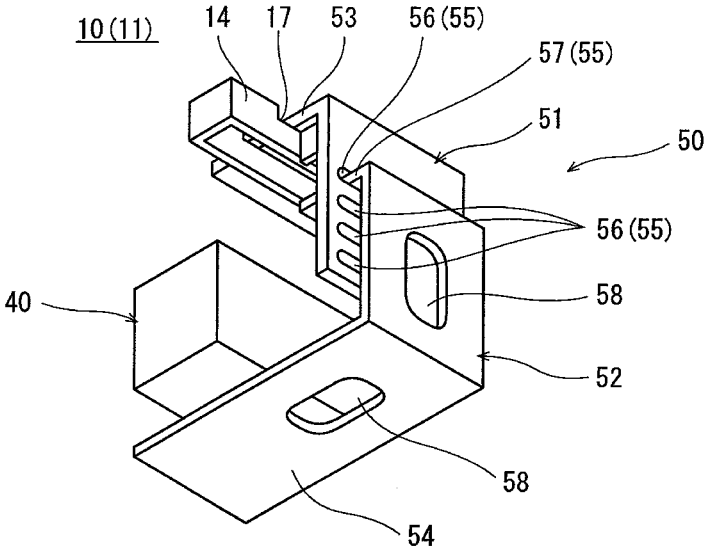
FIG. 5 is a perspective view showing a first embodiment of a jig by which the automatic level controlling valve shown in FIG. 4 is attached to the carbody.
Figure 6:
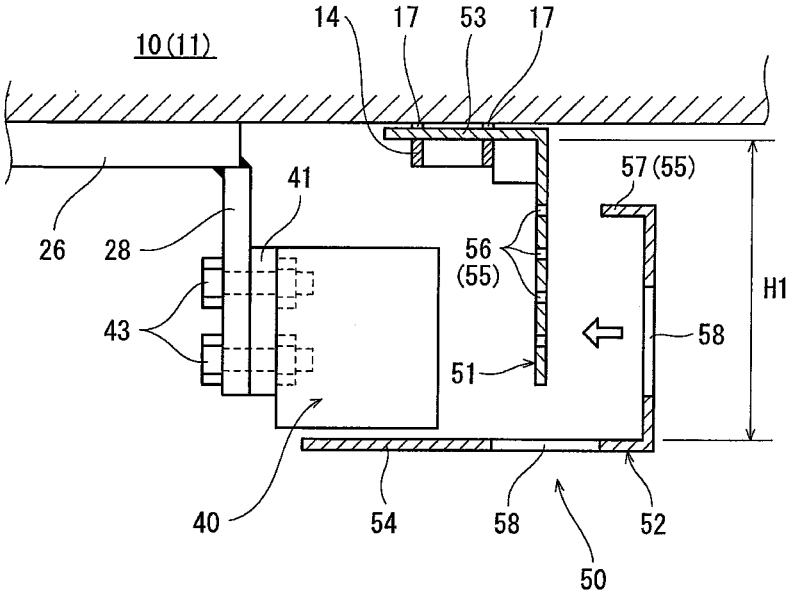
FIG. 6 is a front view showing the jig of FIG. 5, a part of the jig being not attached yet.
Figure 7:
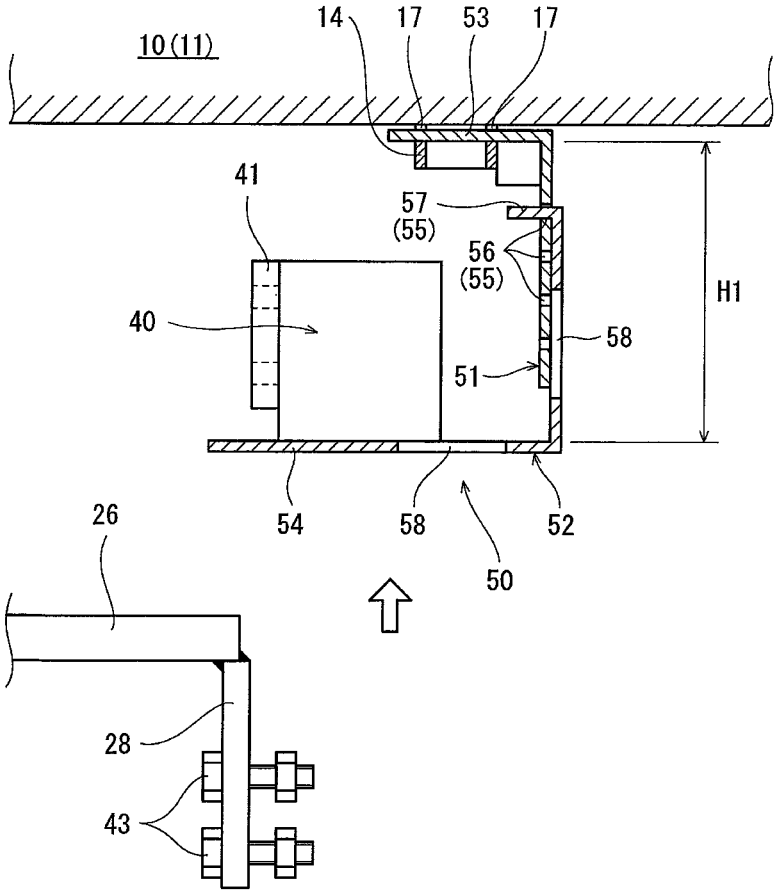
FIG. 7 is a front view showing the jig of FIG. 6 in a state where the automatic level controlling valve is attached to the carbody by the jig.

FIG. 5 is a perspective view showing the first embodiment of the jig 50 by which the automatic level controlling valve 40 is attached to the carbody 10. FIG. 6 is a front view showing a state where a part of the jig 50 shown in FIG. 5 is not yet attached. FIG. 7 is a front view showing a state where the automatic level controlling valve 40 is attached to the carbody 10 by the jig 50 shown in FIG. 6. In FIGS. 5 to 7, the automatic level controlling valve 40 of FIG. 4 is simply shown by a square shape. The second attaching portion 14 provided on the lower surface of the carbody 10 is located at a position above the automatic level controlling valve 40. The second attaching portion 14 is provided with the opening portion 17 to which the jig 50 supporting the automatic level controlling valve 40 is detachably attached.

As shown in FIGS. 5 to 7, the jig 50 of the first embodiment includes a first member 51 having a locking portion 53 located at an upper portion of the first member 51. Further, the jig 50 includes a second member 52 having a supporting portion 54 located at a lower portion of the second member 52. The first member 51 is an L-shaped member including the locking portion 53 which is locked to the opening portion 17 of the second attaching portion 14. The second member 52 is a C-shaped member configured such that: an upper end portion of the second member 52 is engaged with a groove portion 56 formed on the first member 51; and the supporting portion 54 located at the lower portion of the second member 52 supports the automatic level controlling valve 40 from below. The second member 52 is provided with opening portions 58. By the opening portions 58, the second member 52 is reduced in weight, and it is easy for an operator to hold the second member 52.

At a coupling portion between the first member 51 and the second member 52, the jig 50 includes an adjustment mechanism 55 configured to adjust a distance H1 from a position of the locking portion 53 to a position of the supporting portion 54. The adjustment mechanism 55 of the jig 50 of the first embodiment includes: a plurality of groove portions 56 provided at predetermined intervals in the upward/downward direction of the first member 51; and an engaging portion 57 provided at the upper end portion of the second member 52. The engaging portion 57 is engaged with any one of the groove portions 56. The adjustment mechanism 55 adjusts the distance H1 from the position of the locking portion 53 to the position of the supporting portion 54 by changing the groove portion 56 with which the engaging portion 57 is engaged. It should be noted that the positions of the groove portions 56 and the position of the engaging portion 57 may be reversed. The adjustment mechanism 55 may be configured such that: the groove portions 56 are provided at one of the first member 51 and the second member 52; and the engaging portion 57 is provided at the other of the first member 51 and the second member 52.

According to the adjustment mechanism 55 of the jig 50 of the first embodiment, before the automatic level controlling valve 40 is detached from the interface plate 26, the locking portion 53 of the first member 51 is inserted into and hooked to the opening portion 17 of the second attaching portion 14 of the carbody 10. Next, the engaging portion 57 of the second member 52 is engaged with a selected one of the plurality of the groove portions 56 of the first member 51. The adjustment mechanism 55 can select the groove portion 56 with which the engaging portion 57 is engaged. Since the adjustment mechanism 55 is configured such that the engaging portion 57 is engaged with the groove portion 56, a tool or the like is not required. With this, the jig 50 can be attached to such a position that the supporting portion 54 can support the automatic level controlling valve 40. As above, the second member 52 is suspended from the first member 51, and the distance H1 from the position of the locking portion 53 to the position of the supporting portion 54 is adjusted in accordance with the position of the automatic level controlling valve 40 to be detached.

Therefore, according to the jig 50 of the first embodiment, when realizing a state where the automatic level controlling valve 40 is detached from the interface plate 26 and is attached to the carbody 10, the locking portion 53 of the first member 51 is locked to the second attaching portion 14. Then, the adjustment mechanism 55 formed at the coupling portion between the first member 51 and the second member 52 adjusts the distance H1 from the second attaching portion 14 to a lower surface of the automatic level controlling valve 40 to support the automatic level controlling valve 40 from below by the supporting portion 54 of the second member 52. By the adjustment mechanism 55, the automatic level controlling valve 40 can be mounted on the supporting portion 54 of the second member 52. In this specification and claims, a "mounted state" is included in an "attached state". Even if a distance from the carbody 10 to the lower surface of the automatic level controlling valve 40 is changed by inserting a height adjusting member (shim) between the bogie 21 and the carbody 10, the adjustment mechanism 55 can appropriately adjust the distance H1 from the second attaching portion 14 to the supporting portion 54 of the second member 52. Therefore, the jig 50 can easily adjust the distance H1 from the second attaching portion 14 of the carbody 10 to the lower surface of the automatic level controlling valve 40 by the first member 51 and the second member 52. The automatic level controlling valve 40 is supported by the second member 52 of the jig 50 from below and thus can be attached to the carbody 10.

After the jig 50 is attached as shown in FIG. 7, the lever 48 or the link 33 is detached at one position. In addition, the second pipe 30 communicating with the air chamber of the air spring 25 of the bogie 21 is detached at the connector portion 31. Then, the bolt-nut 43 by which the fixing plate 41 of the automatic level controlling valve 40 is fixed to the first attaching portion 28 of the interface plate 26 is detached. By detaching the bolt-nut 43, a state where the automatic level controlling valve 40 is mounted on the supporting portion 54 of the second member 52 of the jig 50 is realized. After that, the second pipe 30 connected to the second connection pipe 46 of the automatic level controlling valve 40 is detached at the connector portion 31 (see FIG. 4). By detaching the connector portion 31 of the second pipe 30, the automatic level controlling valve 40 can be separated from the bogie 21 together with the carbody 10. When separating the automatic level controlling valve 40 together with the carbody 10, the interface plate 26 does not exist above the automatic level controlling valve 40. Therefore, the automatic level controlling valve 40 can be lifted upward together with the carbody 10 without contacting the interface plate 26.

To be specific, even when the automatic level controlling valve 40 is detached from the interface plate 26, the automatic level controlling valve 40 does not hang down from the carbody 10 by the first pipe 15. In a state where the automatic level controlling valve 40 is attached to the lower portion of the carbody 10 by the jig 50, the automatic level controlling valve 40 can be integrally conveyed to a predetermined position.

Figure 8:
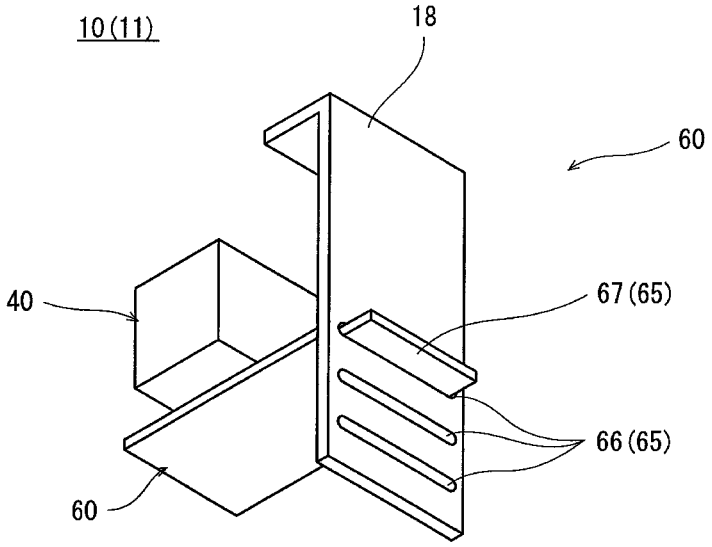
FIG. 8 is a perspective view showing a second embodiment of the jig by which the automatic level controlling valve shown in FIG. 4 is attached to the carbody.
Figure 9:
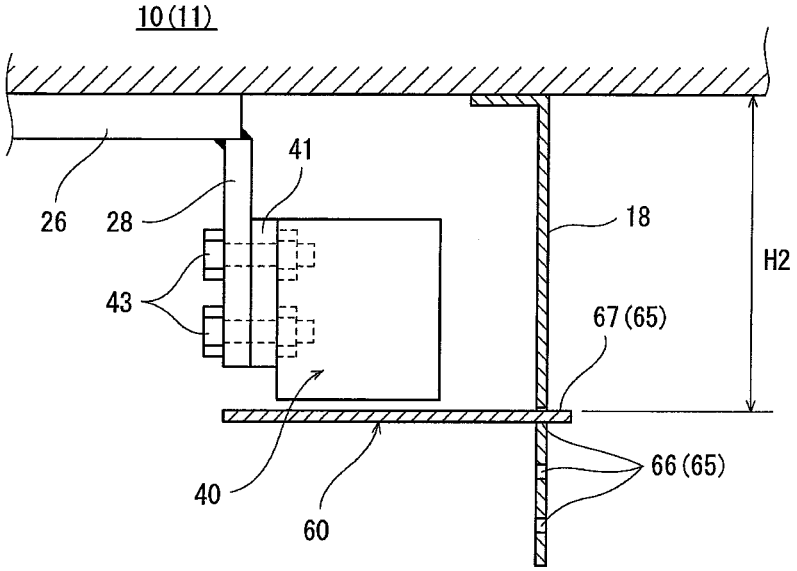
FIG. 9 is a front view showing the jig of FIG. 8 when the jig supports the automatic level controlling valve.

FIG. 8 is a perspective view showing the second embodiment of the jig by which the automatic level controlling valve shown in FIG. 4 is attached to the carbody. FIG. 9 is a front view showing the jig of FIG. 8 when the jig supports the automatic level controlling valve. In FIGS. 8 and 9, the automatic level controlling valve 40 is shown by a square shape. The same reference signs are used for the same components as in FIGS. 5 and 6.

When using the jig 60 of the second embodiment, a plate-shaped second attaching portion 18 extending downward from the carbody 10 is provided on the lower surface of the carbody 10. The second attaching portion 18 is provided with a plurality of groove portions 66 provided at predetermined intervals in the upward/downward direction. The jig 60 of the second embodiment is a plate-shaped member including an engaging portion 67 inserted into the groove portion 66 of the second attaching portion 18. An adjustment mechanism 65 of the jig 60 adjusts a distance 112 from the lower surface of the carbody 10 to the position of the jig 60 by changing the groove portion 66 with which the engaging portion 67 is engaged.

According to the adjustment mechanism 65 of the jig 60 of the second embodiment, before the automatic level controlling valve 40 is detached from the interface plate 26, the engaging portion 67 of the jig 60 is engaged with a selected one of the plurality of groove portions 66 of the second attaching portion 18. In order that the distance H2 from the lower surface of the carbody 10 to the jig 60 becomes an appropriate distance, the groove portion 66 is selected in accordance with the position of the automatic level controlling valve 40 to be detached. With this, the jig 60 can be attached to a position appropriate for supporting the automatic level controlling valve 40. As above, the jig 60 of the second embodiment can be easily attached to the second attaching portion 18. The adjustment mechanism 65 of the jig 60 does not require a tool or the like. After the jig 60 is attached, as with the jig 50 of the first embodiment, the automatic level controlling valve 40 can be detached from the first attaching portion 28 to be separated from the bogie constituting member 20 together with the carbody 10.

As explained above, according to the railcar 1, the state where the automatic level controlling valve 40 is attached to the bogie constituting member 20 with the automatic level controlling valve 40 fixed to the interface plate 26 or the state where the automatic level controlling valve 40 is attached to the carbody 10 with the automatic level controlling valve 40 detached from the interface plate 26 can be selected when separating the bogie constituting member 20 from the carbody 10. Therefore, according to the railcar 1, the state where the automatic level controlling valve 40 is attached to the bogie constituting member 20 or the state where the automatic level controlling valve 40 is attached to the carbody 10 can be selected according to need. On this account, the maintenance or the like of the automatic level controlling valve 40 can be performed together with the maintenance of the bogie constituting member 20 or the maintenance of the carbody 10.

When separating the bogie constituting member 20 from the carbody 10 with the automatic level controlling valve 40 attached to the carbody 10, a state where the jig 50 or 60 is provided at the second attaching portion 14 or 18 provided at the carbody 10 and the automatic level controlling valve 40 is supported from below can be realized. With this, it is possible to easily realize a state where the automatic level controlling valve 40 is detached from the first attaching portion 28 of the interface plate 26 and is attached to the carbody 10 by the jig 50 or 60. Further, in this state, the automatic level controlling valve 40 can be moved upward together with the carbody 10 without interfering with the interface plate 26.

The foregoing has explained the jig 50 of the first embodiment in which the engaging portion 57 of the second member 52 is engaged with the groove portion 56 of the first member 51. The jig 50 is just required to be configured such that the distance H1 between the locking portion 53 of the first member 51 and the supporting portion 54 of the second member 52 is adjustable. Further, as with the jig 60 of the second embodiment, the second attaching portion 18 may be fixed to the carbody 10 as a component corresponding to the first member 51. In this case, when detaching the automatic level controlling valve 40 from the interface plate 26, the jig 60 is attached to the second attaching portion 18 to support the automatic level controlling valve 40 from below.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A railcar comprising:

a carbody;

a bogie constituting member including an interface plate provided at a lower portion of the carbody, an air spring provided at a lower portion of the interface plate, and a bogie provided at a lower portion of the air spring;

an automatic level controlling valve configured to supply air to the air spring and discharge the air from the air spring to maintain a height of the air spring within a certain range;

a first attaching plate provided on a side surface of the interface plate, the automatic level controlling valve being detachably attached to the side surface of the interface plate by the first attaching plate; and attaching means provided at the lower portion of the carbody, the automatic level controlling valve being detachably attached to the lower portion of the carbody by the attaching means, the bogie constituting member being configured to be separated from the carbody both:

in a state where the automatic level controlling valve is attached to the side surface of the interface plate through the first attaching plate, and in a state where the automatic level controlling valve is attached to the lower portion of the carbody through the attaching means.

2. The railcar according to claim 1, further comprising a connector portion for a pipe connected to the automatic level controlling valve, the connector portion being located near the automatic level controlling valve.

3. The railcar according to claim 1, wherein:

the attaching means is a second attaching portion, a jig supporting the automatic level controlling valve being detachably attached to a position above the automatic level controlling valve by the second attaching portion; and the jig includes a locking portion locked to the second attaching portion, and a supporting portion supporting the automatic level controlling valve from below.

4. The railcar according to claim 3, wherein:

the jig includes a first member including the locking portion, and a second member including the supporting portion; and an adjustment mechanism configured to adjust a distance from a position of the locking portion to a position of the supporting portion is provided at a coupling portion between the first member and the second member.

5. The railcar according to claim 4, wherein the adjustment mechanism includes:

a plurality of groove portions provided at one of the first member and the second member at predetermined intervals in an upward/downward direction; and an engaging portion provided at the other of the first member and the second member and configured to be engaged with the groove portion to adjust a distance from the position of the locking portion to the position of the supporting portion.

* * * * *